United States Patent [19]

Hasegawa et al.

[11] 3,967,584

[45] July 6, 1976

[54] SELF-RUNNING AND AUTOMATIC CLEANING COATING MACHINE FOR INTERNAL WALL OF PIPE

[75] Inventors: Akira Hasegawa, Tokyo; Hiromichi Ozoe, Nishinomiya, both of Japan

[73] Assignee: Nippon Kokan Kabushiki Kaisha, Tokyo, Japan

[22] Filed: Sept. 17, 1974

[21] Appl. No.: 506,889

[30] Foreign Application Priority Data

Sept. 19, 1973 Japan ..... 48-104884
Sept. 19, 1973 Japan ..... 48-108751[U]

[52] U.S. Cl. ..... 118/72; 118/DIG. 10; 118/306

[51] Int. Cl.[2] ..... B05C 7/08

[58] Field of Search ..... 118/72, DIG. 10, 306, 118/317; 15/104.05, 104.09, 104.3 R

[56] References Cited

UNITED STATES PATENTS

| | | | |
|---|---|---|---|
| 1,787,126 | 12/1930 | Steinnes | 118/306 |
| 2,262,647 | 11/1941 | Perkins | 118/306 |
| 2,792,807 | 5/1957 | Cummings | 118/72 |
| 3,004,278 | 10/1961 | Stanley | 118/DIG. 10 |
| 3,037,228 | 6/1962 | Cummings | 118/72 |
| 3,135,629 | 6/1964 | McLean | 118/DIG. 10 |

FOREIGN PATENTS OR APPLICATIONS

| | | | |
|---|---|---|---|
| 159,598 | 11/1954 | Australia | 118/DIG. 10 |

*Primary Examiner*—Mervin Stein
*Assistant Examiner*—Douglas Salser
*Attorney, Agent, or Firm*—George B. Oujevolk

[57] ABSTRACT

A self-running and automatic cleaning-coating machine for working the internal wall of a pipe comprising a travel-driving truck, a motor-placing truck a paint-supplying truck and a working truck wherein these trucks are flexibly coupled to one another and including operation mechanisms which is self-running to a required position and automatically operated to clean and coat the internal wall.

2 Claims, 10 Drawing Figures

SELF-RUNNING AND AUTOMATIC CLEANING COATING MACHINE FOR INTERNAL WALL OF PIPE

BACKGROUND OF THE INVENTION

The present invention relates to a self-running and automatic cleaning and painting machine for the internal wall of a pipe, and more particularly, a mechanism capable of doing repair work for damages to the internal coating of a pipe brought about by welding, etc., by only one operation.

BRIEF DESCRIPTION OF THE PRIOR ART

When small diameter pipes are welded and joined on the spot, the high heat by of the welding operations is apt to damage the internal coating of the pipe, especially at the weld zone, even if a sufficient anti-corrosion coating has been given in advance. Therefore, cleaning and recoating operations are, required. However, it was difficult in the prior art to accurately and efficiently perform such cleaning and recoating operations for the internal coating. A machine which runs by itself in the pipe and repairs the required zone is known in the art, but such conventional machines are separately made such as a cleaning machine or as a coating machine and they may do either the cleaning job or the coating job alone when they are run into the pipe once. To perform either one of these jobs, a complex operation of changing the apparatus or jigs out-of-pipe was required, and locating the unit within the pipe was required each separate time. It was unavoidable that the efficiency became bad. Thus, the time loss became great consequently, if the pipe to be repaired was as small as 150A in diameter, the difficulties following the piping speed increased, besides the limited applicability of the machine to a turn of piping.

The present invention has been developed to obviate the disadvantages and defects as mentioned above. The features of the invention lie in a self-running machine comprising a travel driving truck, a motor-placing truck, a paint-supplying truck and a working truck wherein these trucks are flexibly coupled to each other and include an automatic operation mechanisms. The working truck is composed of a cleaning and coating mechanism which are connected to one of double shafts.

An object of the invention is to provide a mechanism useful for on-the-spot pipe repairs.

Another object of the invention is to provide a mechanism capable of automatically cleaning and coating a damaged zone of this internal wall of a pipe by only one travel of the machine.

Other objects and advantages will be apparent from the following description and the accompanying drawings, in which.

Figure 1:
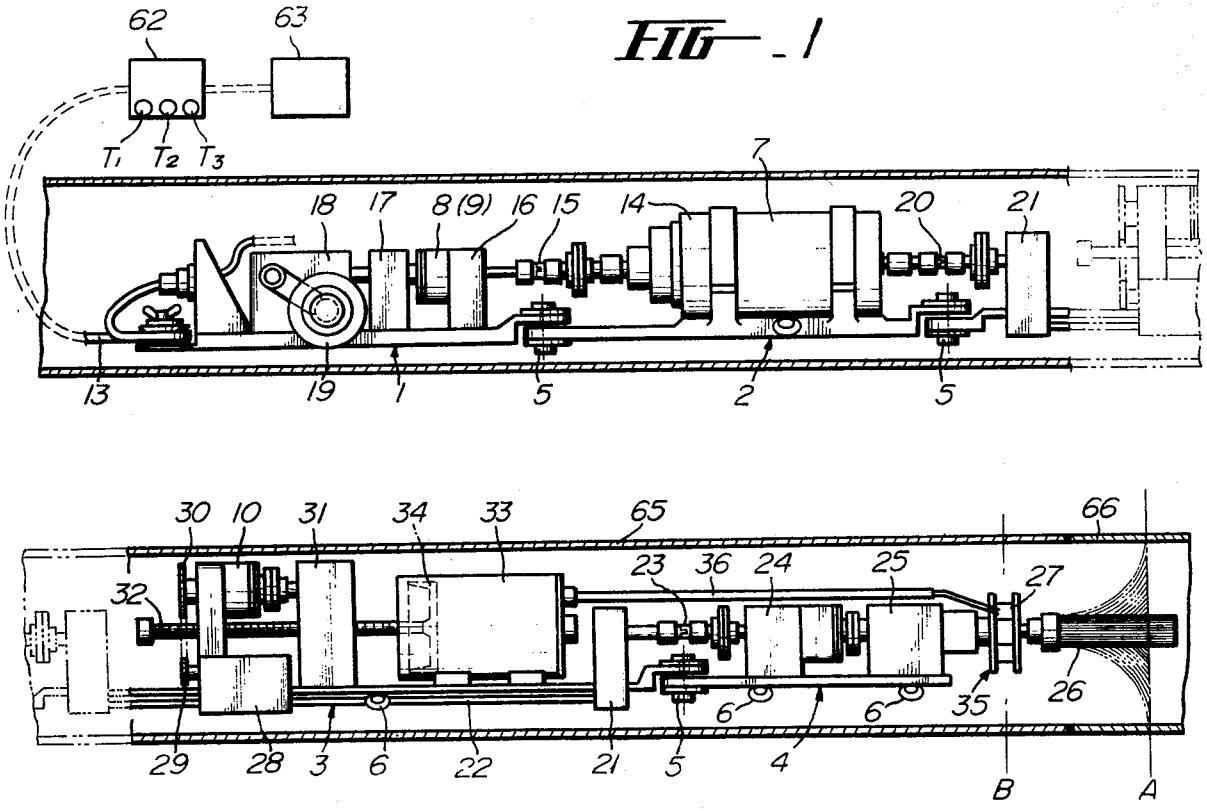
FIG. 1 shows a diagramatical side view of a self-running automatic cleaning and coating machine for the internal wall of a pipe in accordance with the present invention.
Figure 6:
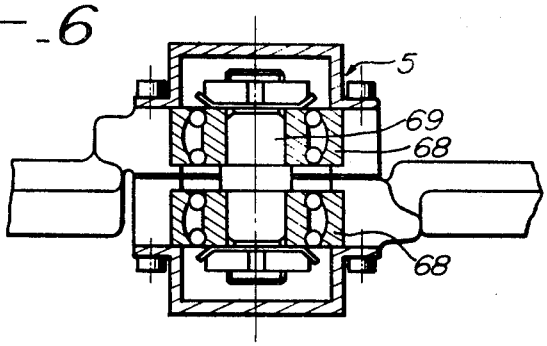
FIG. 6 is a cross sectional view of a coupling structure between the trucks in FIG. 1.

One embodiment of the present invention is now explained reference being made to the attached drawings, wherein an apparatus embodying the present invention and applicable to the repair job of the internal weld zone in a small pipe of about 150A diameter. The machine is constructed in such a way that it may roughly be divided into a truck for travel-driving 1, a truck for carrying motor 2, a truck for supplying paint 3 and a work truck 4, as shown in FIG. 1. Respective trucks 1, 2, 3 and 4 are, as shown in further detail in FIG. 6, coupled flexibly to each other by a joint comprising bearings 68, 68 and shaft 69. The driving truck 1 is provided with driving wheels 19 and other trucks 2, 3, 4 are provided with driven wheel 6 respectively.

Figure 2:
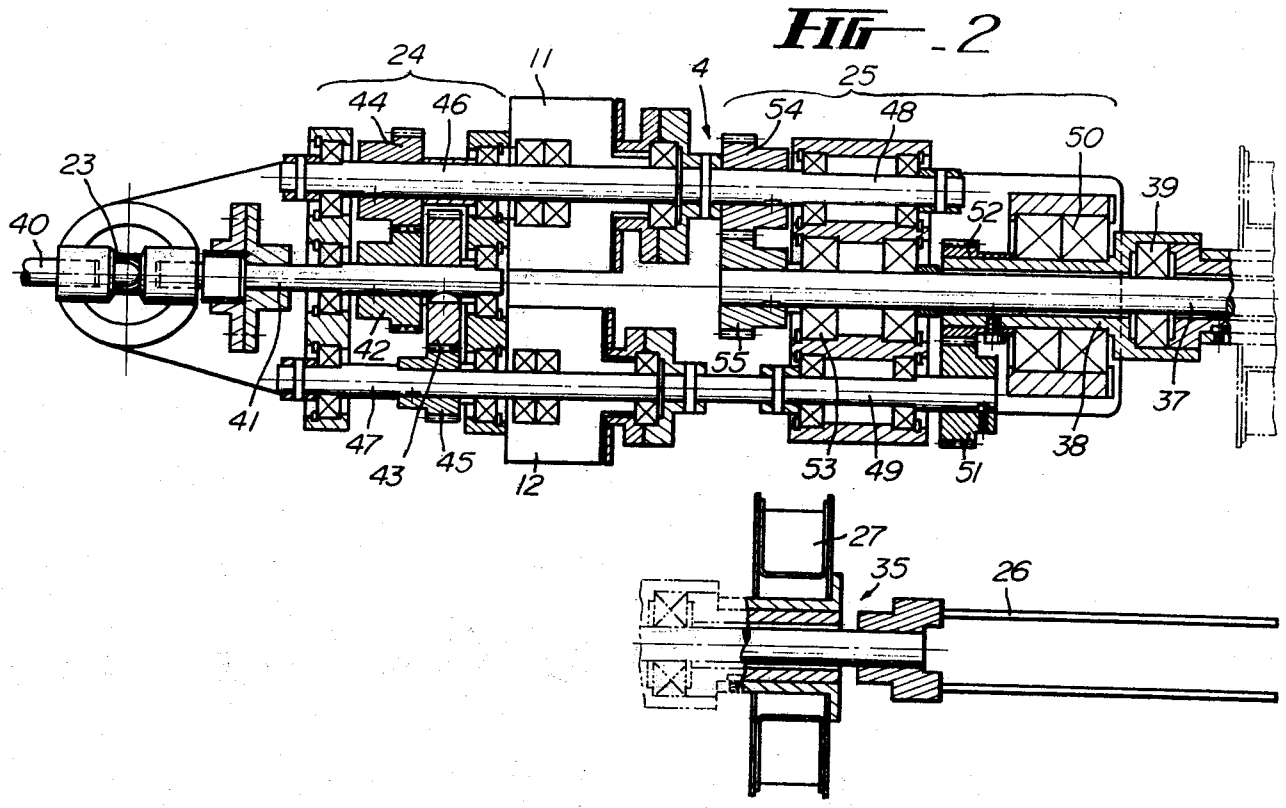
FIG. 2 is a horizontal plane view showing the details of the working truck in FIG. 1.

The working truck 4 which comes at the head of the line is provided with cleaning and coating mechanism 35 fixing a cleaning brush 26 and coating a rotary blade 27 to the double shaft. The details thereof are shown in FIGS. 1 and 2, and more concretely speaking there is provided a power transmission mechanism 24 at the rear of the working truck 4 having a driven shaft 41 connected to a shaft 40 of the power transmission mechanism 21 of the coating truck 3 via a universal joint 23, while on the other hand there is another power transmission mechanism 25 in the front of the power transmission mechanism 24 and an electro-magnetic clutch 11 for cleaning and an electro-magnetic clutch 12 for coating are provided between these two power transmission mechanisms 24, 25. Within said power transmission mechanism 24 at the rear of both sides of the driven shaft 41 are arranged the driving shaft for cleaning 46 and the driving shaft for coating 47 each having gears 44, 45 to engage gears 42, 43 provided on the driven shaft 41. The electro-magnetic clutches for cleaning 11 and for coating 12 are connected to such driving gears 46, 47 respectively, while within the power transmission mechanism at the front 25 is provided driven shafts 48, 49 corresponding to the driving shafts 46, 47, thereby facilitating driving by alternately turning on the said respective electro-magnetic clutches 11, 12. There is provided a hollow shaft 38 via a bearing 50 in the front part of the power transmission mechanism 25, the end of the hollow shaft 38 extending from the truck and has a rotary blade for coating 27. At the rear of the hollow shaft 38 is a gear 52 engaging a gear 51 of the driven shaft 49, and as the gears 51, 52 are driven the rotary blade or an impeller is turned at a predetermined speed. On the other hand, a rotating shaft 37 is inserted via bearing 39 into the hollow shaft 38, the end of the rotating shaft 37 extends beyond the hollow shaft 38 and there is a cleaning brush 26 such as a wire brush attached thereto. The rear part of the rotating shaft 37 which is supported by the bearing 53 has a gear 55 tO engage a gear 54 of the driven shaft 48. When these gears 54, 55 are driven, the cleaning brush 26 is rotated.

Figure 3:
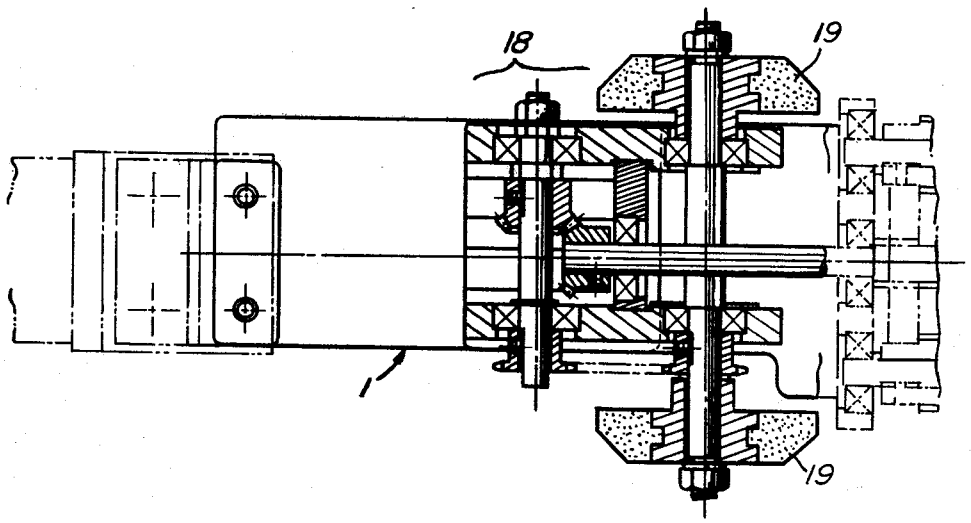
FIG. 3 is a horizontal plane view showing the details of the travel-driving truck in FIG. 1.
Figure 3:
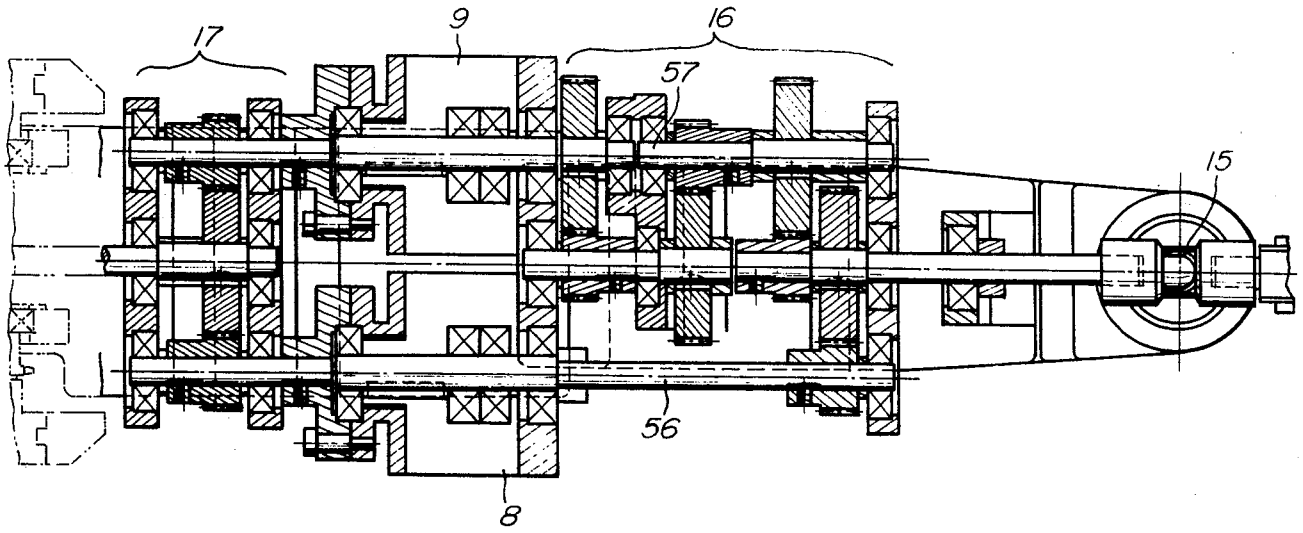

The driving power which runs the working truck 4 and the driving of the cleaning coating mechanism 35 are supplied by trucks 1, 2 and 3; the truck carrying motor 2 has a motor of a comparatively small size 7 and a reduction gear 14 and the travel-driving truck 1 following the motor carrying truck 2 has a driving mechanism which causes all these trucks 1, 2, 3, 4 to travel within the pipe by the driving force of motor 7. The driving mechanism is shown in detail in FIG. 3, and consists of a reduction gear 14 of motor truck 2, a reduction gear 16 connected by a universal joint 15, an electro-magnetic clutch for high speed 8 and an electro-magnetic clutch for low speed 9 connected to the respective shaft 56 and 57 within reduction gear 16, and a driving force transmission mechanism 17, 18 for the electro-magnetic clutches 8, 9 via chain. Accordingly, it is possible to move working truck 4 at a predetermined speed, that is at a high speed or at a low speed, by changing over the driving force of the motor 7 with the two electro-magnetic clutches 8, 9.

Figure 4:
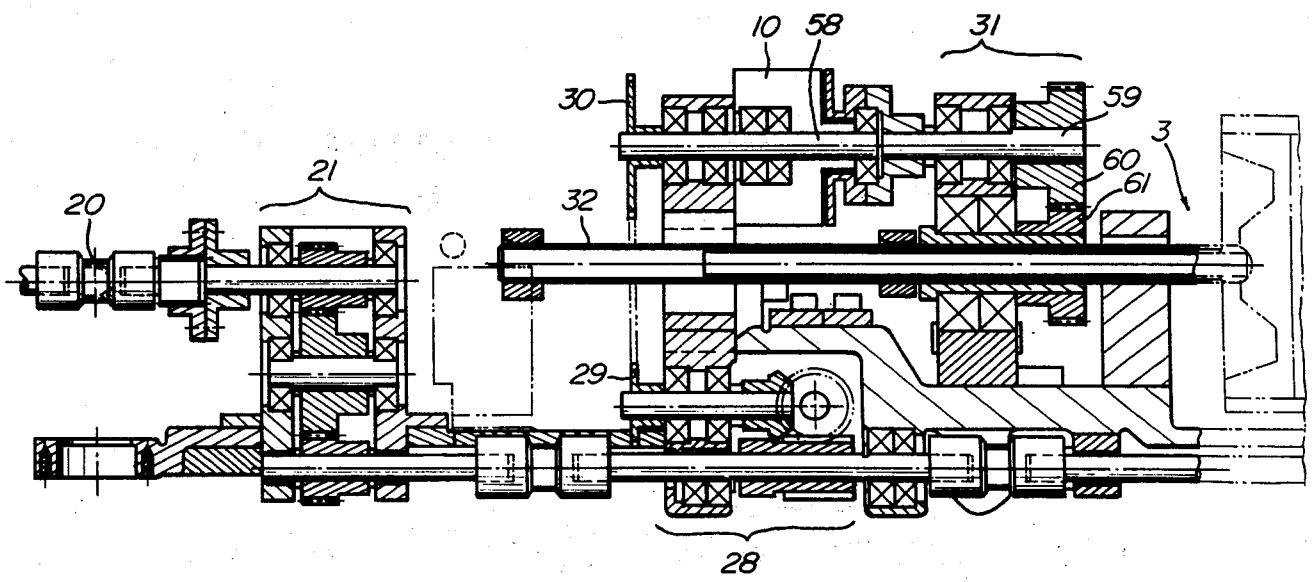
FIG. 4 is a vertically sectioned side view of the paint supply truck in FIG. 1.
Figure 4:
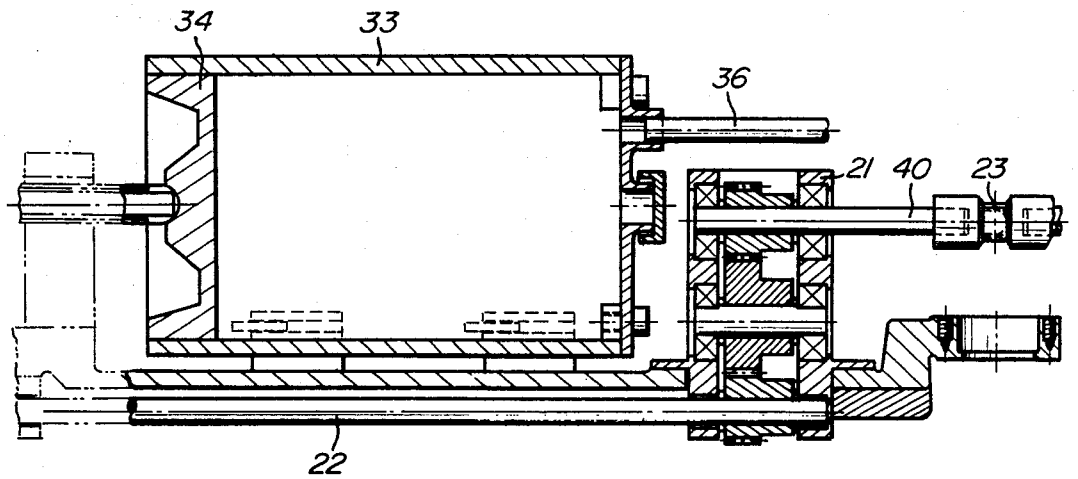
Figure 5:
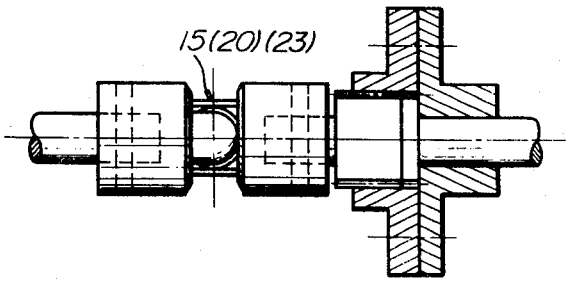
FIG. 5 is a side view of one representative example of a driving force transmission mechanism between the trucks in FIG. 1.

As shown in detail in FIG. 4, the paint supply truck 3 connected to the motor placing truck 2 is provided at both ends with a pair of power transmission mechanisms 21, 21 and a long transmission shaft 22 extending in back of the base of the truck between these two transmission mechanisms 21, 21 and connected thereto. The transmission mechanism 21 in the rear is connected to the motor shaft of the motor carrying truck 2 by a universal joint 20. As has been mentioned, the power transmission mechanism 24 is connected to to the work stand 4. Accordingly, the motor 7 is driven to operate the cleaning brush 26 or the coating rotary blade 27 via electro-magnetic clutch 11 or 12. The paint supply truck 3, on the other hand, has a paint storing and feeding mechanism consisting of a piston 34 for feeding the paint to the rotary blade 27, and a paint cylinder 33 with a mechanism to move the piston. The details of this mechanism is depicted in FIG. 4, showing a reduction mechanism 28 comprising of a worm, a worm wheel and a bevel gear attached to the transmission shaft 22, the top of the said mechanism 28 having a sprocket 29 of the rotating shaft thereof and a sprocket 30 connected by a chain on one end, and the rotating shaft 58 on the other end having an electro-magnetic clutch 10 for pushing the paint. There is further provided a power transmission mechanism 31 which has a screw shaft 32 for pressuring the piston 34 arranged between the reduction mechanism 28 and the paint cylinder 33, and a shaft 59 which runs through power transmission mechanism 31 connected to the rotating shaft 58 via the clutch. There is further provided a gear 61 screwed onto the screw shaft 32 corresponding to the gear 60 fitted up on the said shaft 59. Therefore, when the electro-magnetic clutch 10 for supplying paint is turned on, the piston 34 moves via gears 59, 60 and screw shaft 32 to push the paint out of the paint cylinder 33 into the paint feeding tube 36. The paint thus pushed out is fed to the rotary blade 27 from the nozzle.

Figure 8:
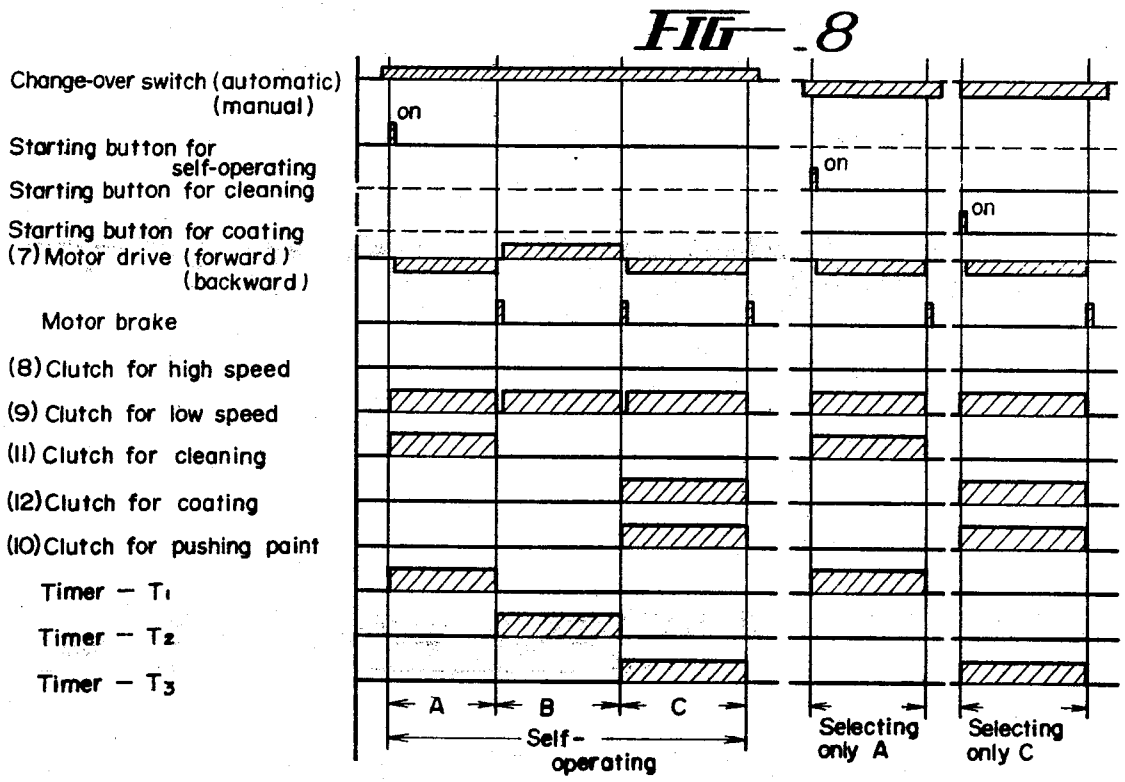
FIG. 8 shows a pattern of automatic sequence for the repair zone of pipe in accordance with the invention.

At the rear of the said travel-driving truck 1, as shown in FIG. 1, a cable 13 from a power source 63 is connected through control unit 62 to the motor 7 of the motor carrying truck 2 with electro-magnetic clutch for high speed 8 and for low speed 9 of the travel-driving truck 1, the electro-magnetic clutch for pushing paint 10 on the paint supplying truck 3, and the electro-magnetic clutch for cleaning 12 and that for coating 12 on the working truck 4. The control unit 62 is provided with a fully automatic operating circuit and a selective operating circuit such as that for cleaning or coating, which is respectively operated by a change-over switch, start button, etc. for an operation in the predetermined sequence as shown in FIG. 8. The control unit is further provided with timers $T_1$, $T_2$, $T_3$ to control the acting time of the motor 7 and turning on and off of the electro-magnetic clutches 8, 9, 10, 11, 12 corresponding to the distance to be cleaned, distance to be coated and speed of the trucks.

In the present embodiment, the four trucks, i.e. travel-driving truck 1, the motor-carrying truck 2, paint supplying truck 3 and the working truck 4 are connected together in order to reduce the whole unit so that it may run itself automatically in a smooth manner even in a small pipe of about 150A diameter and a pipe having a comparatively large turning degree.

OPERATION OF THE INVENTION

Assume that the corrosion resistant coating 64' between a — a' i.e. weld zone and the affected zone, was damaged by the welding heat for pipes 65, 66 which were coated with corrosion resistant coating 64, 64 on the internal wall and the damaged area a — a' is to be repaired. First, the machine comprising the 4 trucks is inserted into the pipe and then the push button in the control unit is turned on. With this the motor 7 is driven and the high speed electro-magnetic clutch 8 is let in. The rotating force of the motor 7 is then transmitted through the reduction unit 14 and universal joint 15 to the reduction unit 16, the high speed electro-magnetic clutch 8, power transmission mechanisms 17, 18 and driving wheel 19 on truck 1 so that the machine may arrive at the repair zone automatically by the timer as mentioned above. Once the machine arrives at the zone, first, the part b — b' including the above a — a' is cleaned and then the zone c — c' which is somewhat larger than the cleaned b — b' is coated.

More concretely these steps are performed in the following manner. First, the working truck 4 travels by letting in the low speed electro-magnetic clutch 9 and the electro-magnetic clutch 11 for cleaning is let in. Thus, the rotating force of the motor 7 is transmitted to the power transmission mechanism 21, the transmission shaft 22 and the other power transmission mechanism 21 on the paint-supplying truck 3 via the universal joint 20, and further to the driven shaft 41 in the power transmission mechanism 24 on the working truck 4 via the universal joint 23 by the shaft of the other power transmission mechanism 21, in order to rotate the transmission shaft 46 for cleaning by the gear 44 engaging with the gear 42 of the said shaft. The rotating power is still further transmitted to the driven shaft 48 via electro-magnetic clutch 11 for cleaning to operate the rotating shaft 37 by gear 55 engaging with gear 54 of the driven shaft 48. This will cause rotating and the spreading-out of cleaning brush 26 by centrifugal force which in turn will remove the extraneous substances like welding slags and dirts and the paint on the damaged zone by coming into contact with the brush. Prior to the above cleaning operaton, the location of the machine at a desired spot is carried out. This is achieved by aligning the point A, at which the cleaning brush 26 as it was spread out by the above centrifugal force in the state shown in FIG. 1 comes into contact with the internal wall of the pipe 66, with the point $A_1$ shown in FIG. 7. After this is completed, push button-operation of the control unit 63 will accomplish the work above mentioned.

In the pattern shown in FIG. 8, a fully automatic operation is achieved by changing over the switch to "auto" and by pushing the start button so that the motor is started the low speed electro-magnetic clutch 9 and the cleaning electro-magnetic cluch 11 are let in. The distance $A_1 — A_2$ is set on the timer $T_1$ corresponding to the running speed of the machine and then the reverse rotation of the motor 7 cause the machine to move backward at a low speed for a predetermined period of time between the points $A_1$ and $A_2$ with the cleaning brush 26 performing cleaning and comes to a stop automatically as the cleaning brush 26 reaches the point $A_2$, thus completing the removal of the extraneous substances in "b — b'" and the paint etc, in "a — a'".

Figure 7:
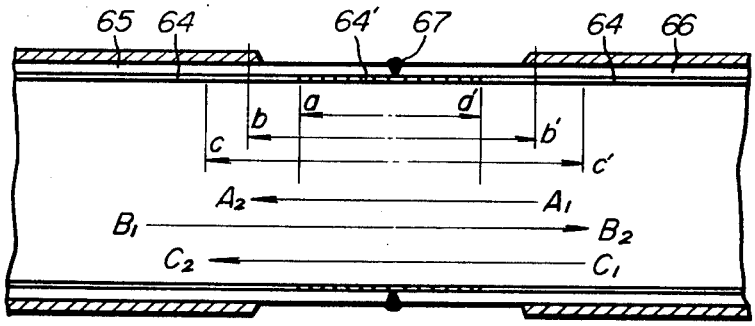
FIG. 7 shows an explanatory diagram for the relationship between the repair zone of pipe and the moving distance of the instant machine.

The coating operation is then carried out between "c — c'" which is somewhat larger than the zone b — b which has just been cleaned in FIG. 7. At the time the above mentioned cleaning work is completed, the center B of the rotating blades 27 for coating, as shown in FIG. 1 is at the position $B_1$. Accordingly said rotating blades 27 are moved to the position $B_2$, prior to the start of the coating job i.e. $C_1$ where the coating job begins. Such a movement is also automatically made upon completion of the cleaning job. As shown in FIG. 8, the distance $B_1 — B_2(C_1)$ is set on the timer $T_2$ of the control unit 63 corresponding to the running speed of the machine. At this time, the motor 7 is rotated normally and the electro-magnetic clutch for low speed 9 is let in to cause the machine to stop automatically when it comes to the position $B_2$ $C_1$. Thus, the rotating blades for coating 27 comes to the position of $C_1$ and the coating job is automatically started. That is to say, the travel driving mechanism acts to cause the machine to run backward at a low speed by the driving power of the motor 7, while on the other hand the electro-magnetic clutch for pushing out the paint 10 and the electro-magnetic clutch for coating 12 are let in, with the latter clutch causing transmission of the driving force successively from the gear 43 of the transmission shaft 41 on the working truck 4 to the gear 45 of the transmission gear for coating 47, the driven shaft 49, the gear 51 of the said driven shaft 49, and the gear 52 of the hollow shaft, thus turning the rotating blades for coating 27 with required high speed rotation. The driving force of the motor is transmitted from the transmission shaft 22 to the reduction mechanism 28, the sprockets 29, 30 and to the electro-magnetic clutch 10 for pushing out the paint. The power transmission mechanism 31 is started via said clutch to turn the screw shaft 32 and to cause the piston 34 arranged at the end of the shaft to advance into the paint cylinder 33 and push out the paint into the paint feeder tube 36 and further to the rotating blades 27. The paint is thrown on the internal wall of the pipe at the scope of the points $C_1 - C_2$ by the centrifugal force of the blades and adheres on the wall. The distance $C_1 — C_2$ in such a coating job is also set on the timer $T_3$ of the control unit corresponding to the running speed of the machine during the coating operation so that the machine wholly ceases driving automatically to the time when rotating blades 27 reach the point $C_2$.

Thus, the repairing work (cleaning and painting) at the pipe joints is performed automatically and efficiently by running the machine into the pipe only once. Naturally, it is possible to select and perform the cleaning job or the coating job alone, in which case the pattern on the right hand side of FIG. 8 may be selected. The repair in accordance with the present invention may be performed on several welded joints in the pipe with one operation when the required paints for such a job are stored in the paint cylinder 33. In this case, the machine is moved from the welded zone at the innermost part of the pipe performing the repair successively toward the entry side.

We claim:

1. A line of trucks as a machine for working within a small diameter pipe, comprising, in line:

a. a travel-driving truck (1) at the rear of the line, having a drive force transmission mechanism (17, 18);

b. a motor carrying truck (2) connected to said travel-driving truck having a motor (7) including high and low speed clutch means (8, 9);

c. a coating material supply truck (3) connected to said motor carrying truck, having coating material storage and feeding means (33, 34) and front and rear drives (21) coupled at one of said drives to said motor (7) and a reduction mechanism coupled to said coating material storage and feeding means (33, 34); and, d. a working truck (4) at the front of the line having first and second transmission means (25, 24), and cleaning and coating means (35) having a brush (26) and a rotary blade (27) operatively coupled with said second transmission means, said second transmission means (24) being coupled to said first transmission means 25.

2. A machine as claimed in claim 1, said travel-driving truck (1) having driving wheels, said four trucks traveling as a unit, said driving wheels being operatively coupled to said motor (7).

* * * * *